US006099447A

United States Patent [19]

Ramsaroop

[11] Patent Number: 6,099,447

[45] Date of Patent: Aug. 8, 2000

[54] EXERCISE BELT

[76] Inventor: Raleigh Ramsaroop, 268 55th St., Brooklyn, N.Y. 11220

[21] Appl. No.: 09/248,713

[22] Filed: Feb. 11, 1999

[51] Int. Cl.[7] ..... A63B 71/00

[52] U.S. Cl. ..... 482/127; 482/124; 482/107

[58] Field of Search ..... 482/106–108, 482/4, 127, 52, 124, 105, 120

[56] References Cited

U.S. PATENT DOCUMENTS

| | | | |
|---|---|---|---|
| 2,512,911 | 6/1950 | Bernice | 482/127 |
| 4,801,137 | 1/1989 | Douglas | 482/107 |
| 5,002,270 | 3/1991 | Shine | 482/105 |
| 5,116,294 | 5/1992 | Findlay | 482/52 |
| 5,358,461 | 10/1994 | Bailey | 482/124 |
| 5,362,295 | 11/1994 | Nurge | 482/124 |
| 5,733,231 | 3/1998 | Corn | 482/120 |

*Primary Examiner*—Jerome Donnelly

[57] ABSTRACT

A exercise belt for exercising the upper body of a user. The exercise belt includes a belt and a pair of cable retracting devices coupled to the belt. Each of the cable retracting devices comprises a housing and a cable that is retractably extended from the housing. A pair of handles are coupled to free ends of the cables.

14 Claims, 3 Drawing Sheets

EXERCISE BELT

BACKGROUND OF THE INVENTION

1. Field of the Invention

The present invention relates to exercise devices and more particularly pertains to a new exercise belt for exercising the upper body of a user.

2. Description of the Prior Art

The use of exercise devices is known in the prior art. More specifically, exercise devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,432,013; U.S. Pat. No. 4,685,671; U.S. Pat. No. 4,441,707; U.S. Pat. No. 5,690,595; U.S. Pat. No. 5,141,223; and U.S. Pat. No. Des. 342,560.

While these devices fulfill their respective, particular objectives and requirements, the aforementioned patents do not disclose a new exercise belt. The inventive device includes a belt and a pair of cable retracting devices coupled to the belt. Each of the cable retracting devices comprises a housing and a cable that is retractably extended from the housing. A pair of handles are coupled to free ends of the cables.

In these respects, the exercise belt according to the present invention substantially departs from the conventional concepts and designs of the prior art, and in so doing provides an apparatus primarily developed for the purpose of exercising the upper body of a user.

SUMMARY OF THE INVENTION

In view of the foregoing disadvantages inherent in the known types of exercise devices now present in the prior art, the present invention provides a new exercise belt construction wherein the same can be utilized for exercising the upper body of a user.

The general purpose of the present invention, which will be described subsequently in greater detail, is to provide a new exercise belt apparatus and method which has many of the advantages of the exercise devices mentioned heretofore and many novel features that result in a new exercise belt which is not anticipated, rendered obvious, suggested, or even implied by any of the prior art exercise devices, either alone or in any combination thereof.

To attain this, the present invention generally comprises a belt and a pair of cable retracting devices coupled to the belt. Each of the cable retracting devices comprises a housing and a cable that is retractably extended from the housing. A pair of handles are coupled to free ends of the cables.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new exercise belt apparatus and method which has many of the advantages of the exercise devices mentioned heretofore and many novel features that result in a new exercise belt which is not anticipated, rendered obvious, suggested, or even implied by any of the prior art exercise devices, either alone or in any combination thereof.

It is another object of the present invention to provide a new exercise belt which may be easily and efficiently manufactured and marketed.

It is a further object of the present invention to provide a new exercise belt which is of a durable and reliable construction.

An even further object of the present invention is to provide a new exercise belt which is susceptible of a low cost of manufacture with regard to both materials and labor, and which accordingly is then susceptible of low prices of sale to the consuming public, thereby making such exercise belt economically available to the buying public.

Still yet another object of the present invention is to provide a new exercise belt which provides in the apparatuses and methods of the prior art some of the advantages thereof, while simultaneously overcoming some of the disadvantages normally associated therewith.

Still another object of the present invention is to provide a new exercise belt for exercising the upper body of a user.

Yet another object of the present invention is to provide a new exercise belt which includes a belt and a pair of cable retracting devices coupled to the belt. Each of the cable retracting devices comprises a housing and a cable that is retractably extended from the housing. A pair of handles are coupled to free ends of the cables.

Still yet another object of the present invention is to provide a new exercise belt that is portable and compact so that it maybe worn and used while standing, walking, sitting, or laying down.

Even still another object of the present invention is to provide a new exercise belt that is particularly useful for bedridden people, such as someone recovering from leg surgery. The exercise belt may be worn by these people to exercise their arms. The same is true for handicapped persons confined to wheelchairs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
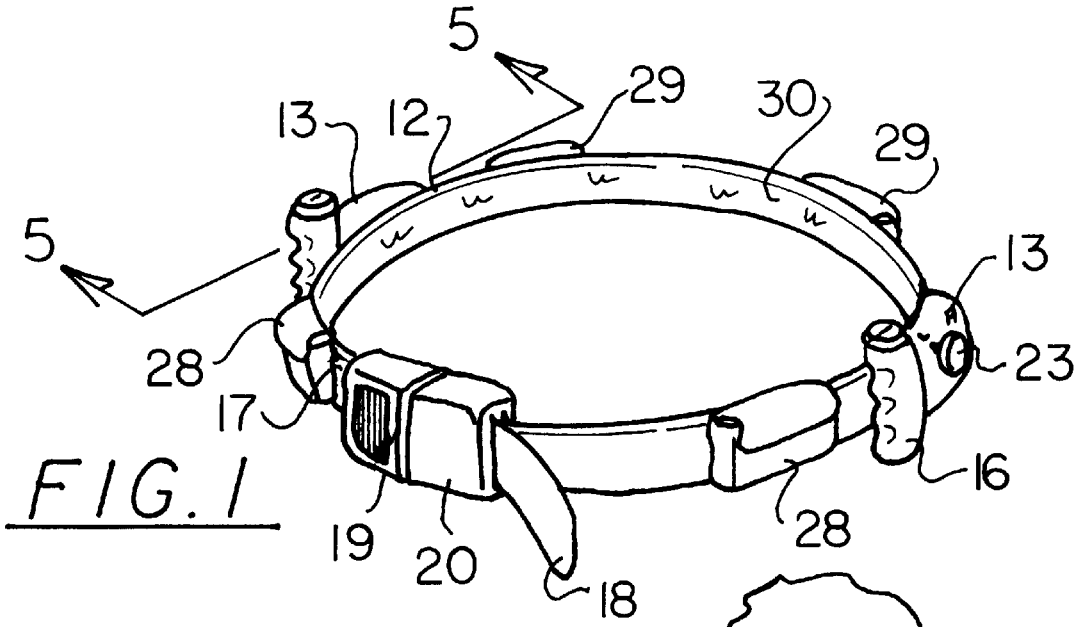
FIG. 1 is a schematic perspective view of a new exercise belt according to the present invention.
Figure 2:
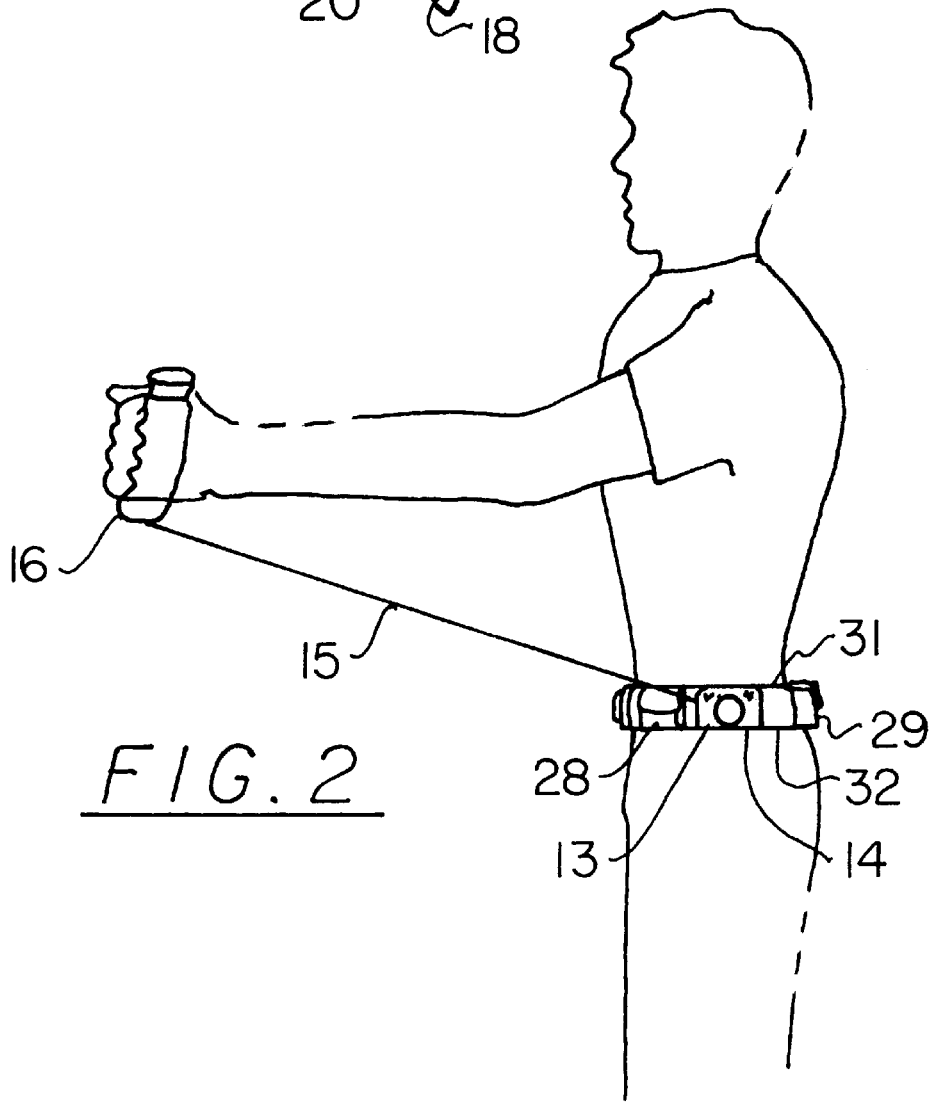
FIG. 2 is a schematic side view of the present invention in use.
Figure 3B:
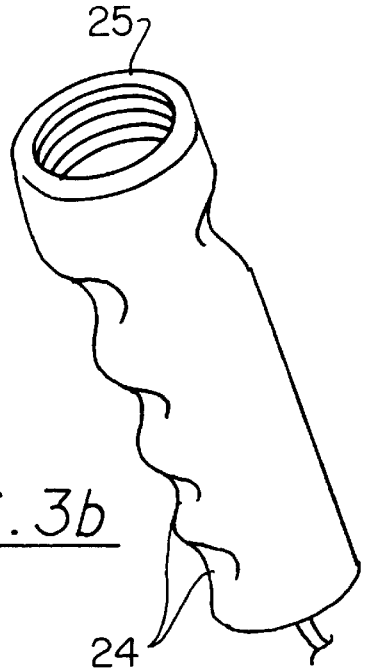
FIG. 3*b* is a schematic perspective view of a handle of the present invention.
Figure 3A:
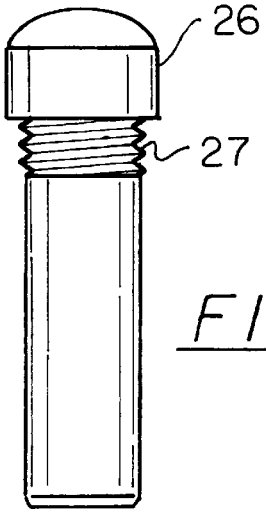
FIG. 3*a* is a schematic side view of a weight of the present invention.
Figure 4A:
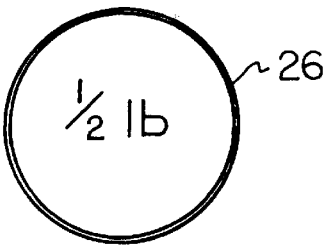
FIG. 4*a* is a schematic end view of the present invention.
Figure 4B:
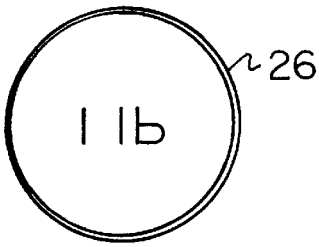
FIG. 4*b* is a schematic end view of the present invention.

With reference now to the drawings, and in particular to FIGS. 1 through 5 thereof, a new exercise belt embodying the principles and concepts of the present invention and generally designated by the reference numeral 10 will be described.

As best illustrated in FIGS. 1 through 5, the exercise belt 10 generally comprises a belt 12 and a pair of cable retracting devices 13 coupled to the belt. Each of the cable retracting devices comprises a housing 14 and a cable 15 that retractably extends from the housing. A pair of handles 16 are coupled to free ends of the cables.

In more detail, the belt is strap-like and has opposite first and second ends 17,18 and a longitudinal axis extending between the ends. Preferably, the first end of the belt has a fastening means 19 coupled to for adjustably coupling the first end of the belt to the belt towards the second end of the belt such that a loop is formed with a diameter that varies with the position of the first end along the belt. Any type of fastening means that is used to adjustably couple a strap to itself to form a loop may be used. For example, FIG. 1 shows a snap lock 20, male and female parts of which are coupled to the second and first ends, respectively. Other alternatives could be use of a hooks and loops fastener or a hinge pin and buckle assembly.

Each of the cable retracting devices comprise a housing and a deformable cable that is retractably extendable from the housing. The cables are positionable between a retracted position and an extended position. The cables are disposed in the housing when in the retracted position. A large portion of each cable is extended from the housing when in the extended position. Preferably, the cables are biased towards the retracted position such that the cable will retract into the housing when released from an extended position.

Preferably, each of the cable retracting devices has a spool 21 rotatably disposed in the associated housing and a coil spring 22 that is coupled to the spool and the housing. The cables are wrapped around the spools. The coil springs bias the spools in a first direction corresponding to wrapping up of the cable from the extended position towards the retracted position.

Figure 5:
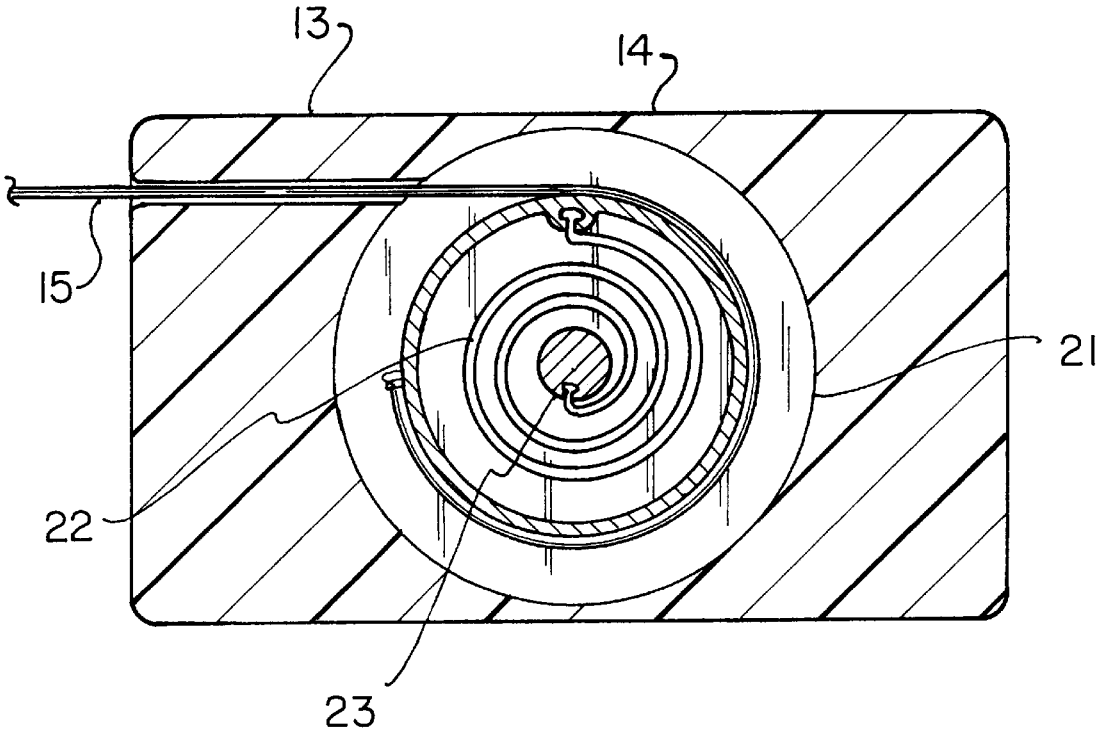
FIG. 5 is a schematic cross sectional view of a cable retracting device of the present invention.

Ideally, each of the cable retracting devices has a tension adjustment knob 23 rotatably extending through the associated housing and that is coupled to the coil spring. As seen in FIG. 5, the tension adjustment knobs permits increasing and decreasing the tension the coil springs exerts on the spools to increase or decrease the resistance to moving the cables toward the extended position, depending on the exercise to be performed. Most ideally, the tension adjustment knobs are held in the selected position by friction, such as pressured contact with the housing or by has a tongue (not shown) that fits into grooves (not shown) of the housing.

The pair of handles are coupled to free ends of the cables. Each of the handles may have a series of shallow corrugations 24 extending along a front side thereof between opposite ends thereof to help prevent slipping of fingers of a hand along the handle.

Preferably, each of the handles is tubular and has a lumen and an open top 25 that provides an opening into the lumen. A plurality of generally cylindrical weights 26 are interchangeably insertable in the lumens of the handles. Ideally, the open top of each of the handles is threaded and each of the weights has a threaded portion 27 for threadably engaging the open tops of the handles.

Ideally, each weight of a first pair of weights weighs about ½ pound, each weight of a second pair of weights weighs about 1 pound, and each weight of a third pair of weights weighs about 1½ pounds.

Preferably, the belt has a pair of forward weight pouches 28 coupled to it. More preferably, the belt also has a pair of rear weight pouches 29 coupled to it. The forward and rear weight pouches each store one of the weights. Ideally, the rear weight pouches have a larger capacity than the forward weight pouches so that the rear weight pouches can hold larger weights and so that the pouch does not get in the way of arm movement when exercising.

Preferably, the belt has a layer of padding 30 extending around its inner surface. The padding is important because it makes using the belt more comfortable, especially for a bedridden or wheelchair bound user, who cannot easily get out of the belt as easily as one not so bound.

Ideally, the padding is porous to permitting flow of air therethrough. This helps prevent the buildup of perspiration between the belt and the user's clothing or skin, thereby increasing comfort.

A length of the belt is defined between its ends. The preferred length of the belt is between about 24 inches for children and 50 inches for larger users.

The belt has top and bottom edge 31,32 between which a width of the belt is defined. The preferred width of the belt is between about 1 and 6 inches. A 1 inch wide belt would be useful for runners and persons done aerobic exercises, where the torso are bending with respect to the waist, since the thinner belt would not restrict such bending nor cause discomfort when bending. A wider belt, such as one with a width of between about 2 and 4 inches, would be preferable for wheelchair confined persons and bedridden persons, since the wider belt would spread out the tension on the belt across a wider strip of the user's back. A 6 inch belt are preferred for power lifters, since the wider belt may be utilized in place of the weight belt commonly worn by power lifters. After a workout, the power lifter could use the exercise device to "warm down."

The preferred length of each of the handles is between about 2 and 5 inches, ideally about 4 inches.

In use, the belt is wrapped around a user's waist and held in place by the fastening means. The handles are grasped and pulled away from the cable retracting devices and then moved towards the cable retracting devices. This process is repeated for a predetermined amount of time. The weights may be placed in the handles for a more strenuous workout. The tension adjustment knobs are manipulated to increase resistance produced by the coil springs.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise device, comprising:

a belt having opposite first and second ends and a longitudinal axis extending between said ends;

a pair of cable retracting devices being coupled to said belt and each comprising a housing and a cable being retractably extended from said housing; and a pair of handles being coupled to free ends of said cables;

wherein each of said handles is tubular and wherein each of said handles is tubular and has a lumen and an open top providing an opening into said lumen, a plurality of generally cylindrical weights being insertable in said lumens of said handles; and wherein said open top of each of said handles is threaded, each of said weights having a threaded portion for threadably engaging said open tops of said handles such that said threaded portion of said weights prevents movement of the said weight in relation to said handle thereby reducing chances of inadvertent muscle strain due to sudden weight shifting, wherein said weights have a cap portion mounted on an end of said threaded portion for closing of said lumen of said handle when said weight has engaged said handle such that interchanging of said weights requires only a single hand of the user.

2. The exercise device of claim 1, wherein said cables are positionable between a retracted position and an extended position, said cables being disposed in said housing when in said retracted position, said cables extending from said housing when in said extended position.

3. The exercise device of claim 2, wherein said cables are biased towards said retracted position.

4. The exercise device of claim 2, wherein each of said cable retracting devices has a spool rotatably disposed in the associated housing and a coil spring being coupled to said spool and said housing, said cable being wrapped around said spool, said coil springs biasing said spools in a first direction corresponding to wrapping up of said cable from said extended position towards said retracted position.

5. The exercise device of claim 4, wherein each of said cable retracting devices has a tension adjustment knob rotatably extending through the associated housing and being coupled to said coil spring, said tension adjustment knobs permitting increasing and decreasing the tension said coil springs exerts on said spools.

6. The exercise device of claim 1, wherein each weight of a first pair of weights weighs about ½ pound.

7. The exercise device of claim 6, wherein each weight of a second pair of weights weighs about 1 pound.

8. The exercise device of claim 7, wherein each weight of a third pair of weights weighs about 1½ pounds.

9. The exercise device of claim 1, wherein said belt has a pair of forward weight pouches coupled thereto, each of said forward weight pouches being for storing one of said weights.

10. The exercise device of claim 9, wherein said belt has a pair of rear weight pouches coupled thereto, each of said rear weight pouches being for storing one of said weights.

11. The exercise device of claim 1, wherein said first end of said belt has a fastening means coupled thereto for adjustably coupling said first end of said belt to said belt towards said second end of said belt such that a loop is formed with a diameter that varies with the position of said first end along said belt.

12. The exercise device of claim 1, wherein said belt has a layer of padding extending around an inner surface thereof.

13. The exercise device of claim 12, wherein said padding is porous for permitting flow of air therethrough.

14. An exercise device, comprising:

a belt having opposite first and second ends and a longitudinal axis extending between said ends;

said first end of said belt having a fastening means coupled thereto for adjustably coupling said first end of said belt to said belt towards said second end of said belt such that a loop is formed with a diameter that varies with the position of said first end along said belt;

a pair of cable retracting devices being coupled to said belt and each comprising a housing and a cable being retractably extended from said housing;

said cables being positionable between a retracted position and an extended position, said cables being disposed in said housing when in said retracted position, said cables extending from said housing when in said extended position;

said cables being biased towards said retracted position such that said cable will retract into said housing released from said extended position;

each of said cable retracting devices having a spool rotatably disposed in the associated housing and a coil spring being coupled to said spool and said housing, said cables being wrapped around said spools, said coil springs biasing said spools in a first direction corresponding to wrapping up of said cables from said extended position towards said retracted position to increase or decrease the resistance to moving said cables toward said extended position;

each of said cable retracting devices having a tension adjustment knob rotatably extending through the associated housing and being coupled to said coil spring, said tension adjustment knobs permitting increasing and decreasing the tension said coil springs exerts on said spools;

a pair of handles being coupled to free ends of said cables;

each of said handles having a series of shallow corrugations extending along a front side thereof between opposite ends thereof for preventing slipping of fingers of a hand therealong;

each of said handles being tubular and having a lumen and an open top providing an opening into said lumen;

a plurality of generally cylindrical weights being interchangeably insertable in said lumens of said handles;

wherein said open top of each of said handles is threaded, each of said weights having a threaded portion for threadably engaging said open tops of said handles such that said threaded portion of said weights prevents movement of the said weight in relation to said handle thereby reducing chances of inadvertent muscle strain due to sudden weight shifting, wherein said weights have a cap portion mounted on an end of said threaded portion for closing of said lumen of said handle when said weight has engaged said handle such that interchanging of said weights requires only a single hand of the user;

wherein a length of each of said handles being between about 2 and 5 inches;

wherein each weight of a first pair of weights weighs about ½ pound;

wherein each weight of a second pair of weights weighs about 1 pound;

wherein each weight of a third pair of weights weighs about 1½ pounds;

said belt having a pair of forward weight pouches coupled thereto, each of said forward weight pouches being for storing one of said weights;

said belt having a pair of rear weight pouches coupled thereto, each of said rear weight pouches being for storing one of said weights;

said rear weight pouches having a larger capacity than said forward weight pouches for holding larger weights;

said belt having a layer of padding extending around an inner surface thereof such that said padding aids in comfort when in use by users having reduced function of the legs;

said padding being porous for permitting flow of air therethrough such that said padding prevents buildup of perspiration between said belt and the user;

a length of said belt being defined between said ends thereof, wherein said length of said belt is between about 24 inches and 50 inches; and said belt having top and bottom edges, a width of said belt being defined between said top and bottom edges thereof, wherein said width of said belt is between about 1 and 6 inches.

* * * * *